United States Patent [19]

Parker et al.

[11] 4,266,539

[45] May 12, 1981

[54] CARBON DIOXIDE SCRUBBER AND GAS REGENERATOR UNIT FOR A CLOSED CIRCUIT REBREATHING APPARATUS

[75] Inventors: Frederick A. Parker, Broomall; Mark P. Grady, Norristown, both of Pa.

[73] Assignee: Rexnord Inc., Milwaukee, Wis.

[21] Appl. No.: 39,235

[22] Filed: May 15, 1979

[51] Int. Cl.[3] ..... A62B 7/10; A62B 7/04

[52] U.S. Cl. ..... 128/204.26; 128/205.12; 128/205.24; 128/202.22; 128/205.28; 55/387; 55/DIG. 35

[58] Field of Search ..... 128/202.26, 205.12, 128/205.28, 205.27, 205.13, 204.28, 205.16, 205.24, 206.17, 202.22, 204.26, 204.22, 204.29; 55/387, 316, 389, DIG. 33, DIG. 35

[56] References Cited

U.S. PATENT DOCUMENTS

| | | | |
|---|---|---|---|
| 3,572,014 | 3/1971 | Hansen | 55/387 X |
| 3,575,167 | 4/1971 | Michielsen | 128/205.28 |
| 3,710,553 | 1/1973 | Parker et al. | 55/316 |
| 4,141,353 | 2/1979 | Dahlback et al. | 128/202.22 |
| 4,157,091 | 6/1979 | Pampuch | 128/202.26 |

FOREIGN PATENT DOCUMENTS

| | | | |
|---|---|---|---|
| 877868 | 5/1953 | Fed. Rep. of Germany | 128/205.12 |
| 1336301 | 7/1963 | France | 128/205.12 |
| 473507 | 10/1975 | U.S.S.R. | 128/202.26 |

*Primary Examiner*—Henry J. Recla

*Attorney, Agent, or Firm*—Beveridge, DeGrandi, Kline & Lunsford

[57] ABSTRACT

A compact, light and highly efficient gas regenerator unit for a positive pressure closed circuit rebreathing apparatus having an improved carbon dioxide scrubber contained within an annular frame to the lower open portion of which a spring loaded flexible diaphragm is sealingly connected around its periphery and across the upper portion of which a cover plate is releasably attachable with the interior of the unit within the frame being divided by a transversely extending partition into a gas conditioning chamber, in which the $CO_2$ of the wearer's expelled breath gases are removed by passing through chemicals compressively retained in the canister of a scrubber extending across the span of the gas conditioning chamber, and a variable volume gas chamber above diaphragm from which the reconditioned gases that have been enriched with a predetermined amount of oxygen are again inhaled. A valving arrangement operated by movement of the spring loaded diaphragm will maintain a positive pressure within the system and add additional oxygen to the variable volume chamber when excess oxygen is being consumed by the wearer or vent excess gases from the chamber when oxygen consumption decreases. An anti-anoxia valve prevents the wearer from breathing into the unit until oxygen is being released into the unit. The design of the reconditioning gas chambers and passages, including the $CO_2$ scrubber, establishes a uniform flow of breathing gases through the scrubber and the unit with a minimum pressure drop.

19 Claims, 10 Drawing Figures

CARBON DIOXIDE SCRUBBER AND GAS REGENERATOR UNIT FOR A CLOSED CIRCUIT REBREATHING APPARATUS

This invention relates to a closed circuit rebreathing apparatus and in particular to a positive pressure apparatus incorporating a compact, light and highly efficient carbon dioxide scrubber and gas regenerator unit into which the wearer exhales his breath and from which the wearer inhales his breath after each exhalation. The rebreathing unit is utilized by personnel in contaminated air spaces, such as smoke filled buildings, mines with contaminated air, etc. The unit may also be utilized by divers in relatively shallow depths of water. In such units the wearer is provided with a breathing mask having exhale and inhale circuits connecting to the mouth piece with check valves for controlling the directional flow of the exhalations and inhalations as the wearer breathes.

The present invention is directed to improvements in prior known, closed circuit types of rebreathing apparatus in establishing a positive internal pressure within the circuit of the closed system with respect to the ambient pressure. Positive internal pressure has been incorporated in previously known open circuit types of breathing apparatus but the configuration of previously known closed circuit types of rebreathing apparatus has been such that internal pressure was not achieved. This positive pressure feature is very important since there can always be some degree of leakage into or out of any closed system. When the wearer of rebreathing apparatus inhales he establishes a small negative pressure in his lungs which is transmitted into a non-positive pressure rebreathing system. This can permit some degree of leakage of the outside ambient atmosphere into the system around the mask of the wearer and other locations that are difficult to seal. Some gases, such as $NO_2$, $H_2S$, $Cl_2$, etc., are highly toxic in exceedingly low concentrations. The positive pressure feature of this invention gives full protection to the wearer in ensuring that any leakage is out from the system into the ambient atmosphere rather than into the system from the ambient atmosphere, which can be quite toxic in many conditions in which wearing of rebreathing apparatus is required.

The present invention incorporates improvements in the gas regenerating unit of a closed system rebreathing apparatus, which reconditions the breathing gas of the wearer of the general nature exemplified by the underwater breathing apparatus described in U.S. Pat. No. 3,710,553. Although the closed circuit, rebreathing apparatus disclosed in that patent is very effective for underwater use, it is not a positive pressure type and is heavy and cumbersome when used for rescue and other close quarters operations in which the wearer must be protected from contaminated air. Compact, light and highly efficient rebreathing apparatus is in demand for use by firemen, mine rescue personnel and others who are required to enter and work in contaminated air spaces which can contain highly toxic gases. It is particularly necessary that the gas regenerating unit of rebreathing apparatus used by personnel for these purposes be of the positive pressure type and be sufficiently light and compact that it may be worn on the back with little encumberance to the wearer in conducting the rescue operations or other work which he must perform in confined spaces. The passages and baffling arrangement within the gas regenerator unit must be such as to provide a minimum pressure drop within the entire rebreathing circuit. Simple means must be provided for maintaining an adequate oxygen level in the gas inhaled by the wearer from the regenerating unit under various conditions of exertion by the wearer and also provide for the venting of any excess gases that accumulate in the unit. Of importance is a well designed carbon dioxide scrubber which is compact, easily removable and which can be easily and quickly refilled with loose particles of carbon dioxide removal chemicals that can be repacked quickly and maintained in a uniformly and tightly compacted state while in use. Likewise of major importance are safety provisions that will protect the wearer from anoxia in the event the oxygen supply valve is not open immediately upon donning the equipment.

An object of this invention is to provide a compact, light and highly efficient gas regenerator unit for a pressurized, closed circuit rebreathing apparatus.

Another object of this invention is to provide a highly efficient carbon dioxide scrubber for the gas regenerator unit which can be quickly and easily replaced.

A further object of this invention is to provide a carbon dioxide scrubber in which the canister holding the carbon dioxide removal particles may be quickly and easily filled to its capacity in a minimum time and the particles maintained in a uniformly, tightly packed condition.

Yet still a further object of this invention is the prevention of anoxia in the event the oxygen supply valve inadvertently remains closed.

Yet still another object of this invention is to provide a compact, light and highly efficient closed breathing apparatus that can be utilized for limited times in underwater conditions.

The above and other objects of the invention will become more apparent when considered in connection with the following specification taken in conjunction with the attached drawings wherein.

Figure 1:
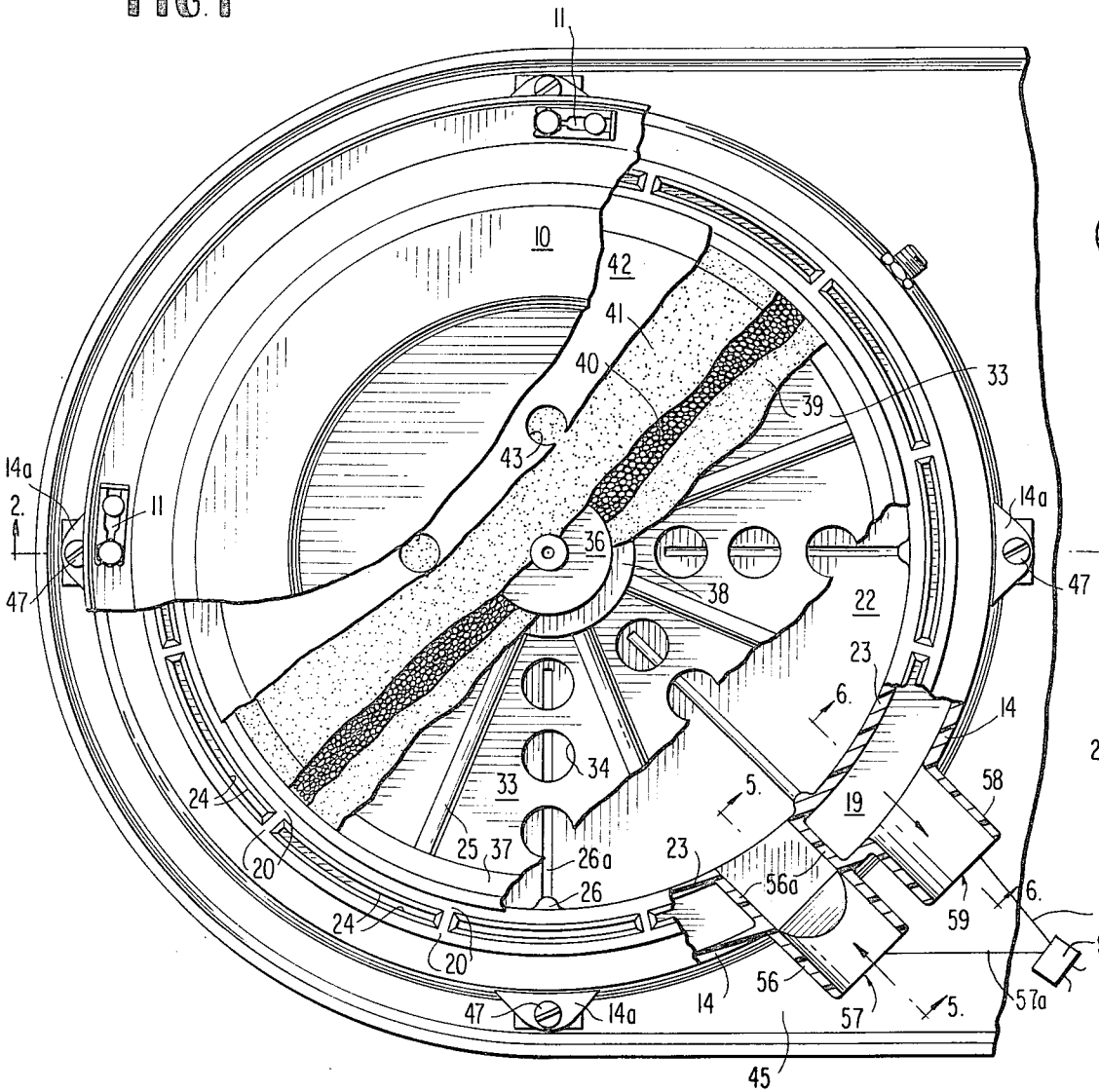
FIG. 1 is a multisectional plan view of the gas regenerator apparatus with portions of the exterior cover removed for easier viewing.
Figure 2:
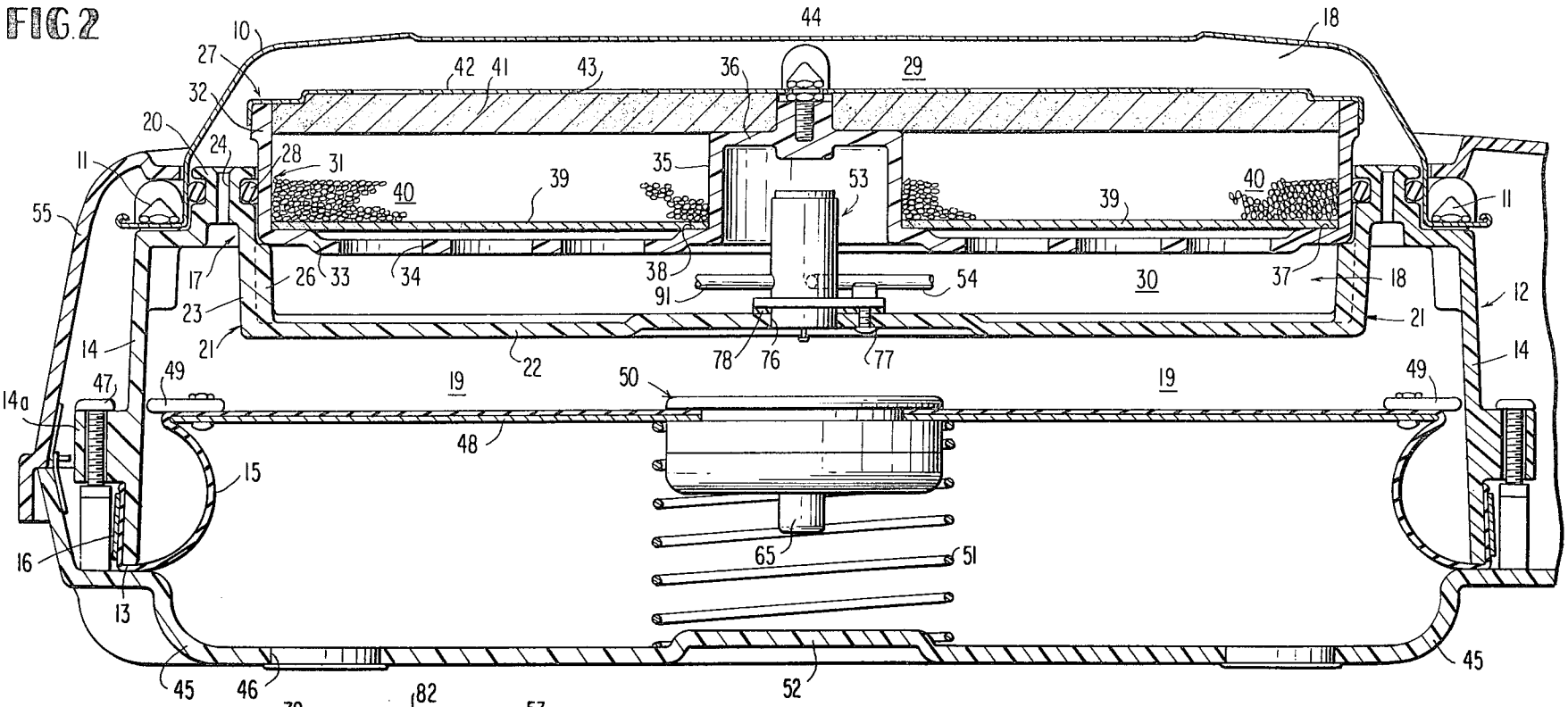
FIG. 2 is a cross sectional view of the apparatus of FIG. 1 along the section line 2—2 but including certain exterior sections of paneling that are not included in FIG. 1.

As may be best seen in FIGS. 1 and 2, the space within the unit in which the wearer's breathing gas is conditioned and regenerated is enclosed within a domed top cover plate 10 releasably attached at spaced intervals by slide fasteners 11 to a hollow frame member 12 having an open bottom portion defined by the lower edge 13 of an annular, outer peripheral wall section 14 and having a flexible diaphragm 15 sealingly secured around its periphery to the lower periphery of the frame peripheral wall section 14 by a clamping band 16. An upper pan portion 17 of the frame member 12, opposite the bottom open end defined by the peripheral wall lower edge 13, extends transversely across the span of the annular peripheral wall 14 and divides the interior of the gas regenerating unit into a gas conditioning chamber 18 defined between the top cover plate 10 and the frame upper pan portion 17 and a variable volume gas chamber 19 enclosed within the frame outer peripheral wall 14 and the flexible diaphragm 15. The upper pan portion 17 of the frame has an annular shoulder 20 that joins the upper end of the frame outer peripheral wall 14 with a dish-shaped central portion 21 within which the carbon dioxide scrubber is supported. This dish-shaped central portion has an imperforate bottom 22 extending transversely of and concentrically within an annular wall portion 23 that extends upwardly from the outer periphery of the pan 22 to the frame annular shoulder 20. The frame annular shoulder 20 contains a series of elongatedp passages 24 around its circumference that interconnect the upper portion of the gas conditioning chamber 18 with the variable volume gas chamber 19. The annular wall portion 23 of the dish-shaped portion of the frame member has a number of outwardly extending bosses 26 spaced around its periphery that extend partially upwardly along the wall portion from radially extending grooves **26*a* in the bottom 22** of the upper frame pan portion to form a plurality of cartridge supporting surfaces around the periphery of the dish-shaped frame portion.

The carbon dioxide scrubber 27 is supported on the top surfaces of the bosses 26 and is sealingly held within the frame dish-shaped portion 21 by the O-ring 28 in a manner to divide the gas conditioning chamber 18 into an upper chamber 29 and a lower chamber 30. The carbon dioxide scrubber includes an annular, doughnut shaped canister 31 having an open top end defined by the top edge of its outer peripheral wall 32 that extends upwardly from the outer periphery of a transversely extending, annular bottom section 33 pierced by a number of openings 34 that are arranged in radial rows around the span of the bottom section. The central portion of the canister bottom section has an upwardly extending inner wall 35 across the top periphery of which is a transversely extending central segment 36 that is below the level of the top edge of the canister outer wall 32. The periphery of the canister annular bottom section 33 adjacent the canister outer and inner walls 32 and 35 has flat, annular filter element supporting surfaces 37 and 38, with radially extending ribs 25 extending between them, that are raised a short distance above the perforated area of the canister bottom section 33 on which an annular, doughnut shaped filter element 39 is supported in a spaced relationship above the perforated bottom section 33 of the canister. A suitable material for the filter element 39 is a one eighth inch thick sintered polyethylene sold under the trademark of "POREX". Loose particles of carbon dioxide removal chemical 40, such as Sodasorb, fill the canister above the filter element 39 to at least the level of the canister inner central segment 36. A suitable form of Sodasorb is a type A 4 to 8 mesh with 14% to 19% moisture and low density. A pad 41 of resilient, compressive material, such as an open cell foamed polyurethane, overlies the dioxide removal chemicals. The porous pad is compressively pressed against the loose carbon dioxide removal particles by a canister cover 42 having a series of spaced perforations 43, the center of the canister cover being releasably attached to the central segment 36 of the canister 27 by a slide fastener 44.

The open end of the frame member 12 is enclosed by a bottom cover plate 45 affixed to tabs **14*a* extending at spaced intervals around the peripheral wall section 14 of the frame 12 by bolts 47. This cover plate has spaced openings 46 over that area lying below the open end of the frame member 12. A flat plate 48 is affixed to the underside of the flexible diaphragm 15 and overlying guides 49 are affixed to the diaphragm and to the outer periphery of the plate 48 at spaced intervals with the inner edge of the guides 49 in close proximity to the frame peripheral wall 14 to guide the diaphragm in any upward or downward movement. A dual vent valve 50, to be subsequently described, is supported by the central portion of the diaphragm and diaphragm plate 48, the top portion of the vent valve being in the variable volume gas chamber 19 with the lower portion extending into the space between the flexible diaphragm 15 and the bottom cover plate 45. A spiral spring 51 fitting around the lower portion of the vent valve 50 extends between the diaphragm plate 48 and a raised portion 52 in the center of the bottom cover plate to bias the flexible diaphragm upwardly against the gas pressure within the variable volume gas chamber 19**.

An oxygen metering device 53, to be subsequently described, is affixed to the center of the pan 22 of the frame dish-shaped portion 21 with the top portion extending upwardly within the lower gas conditioning chamber 30 in the space provided by the upwardly extending inner wall 35 of the canister and the lower end protruding through the pan 22 of the frame dish-shaped segment into the variable volume gas chamber 19. The metering device connects to an oxygen supply bottle 87 through the shut-off valve 88 in the supply pipe 54 and to the anti-anoxia device 90 through the pressure line 91.

Figure 5:
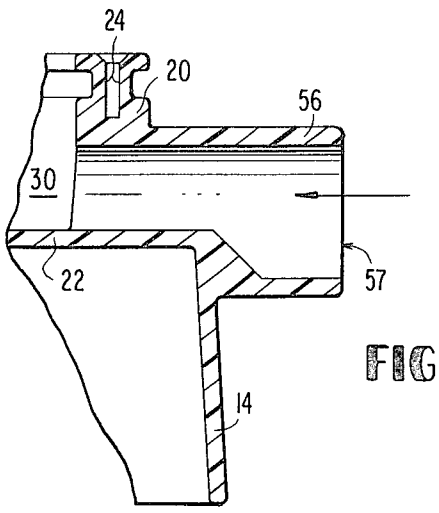
FIG. 5 is a partial cross section of the unit along section line 5—5 of FIG. 1.
Figure 6:
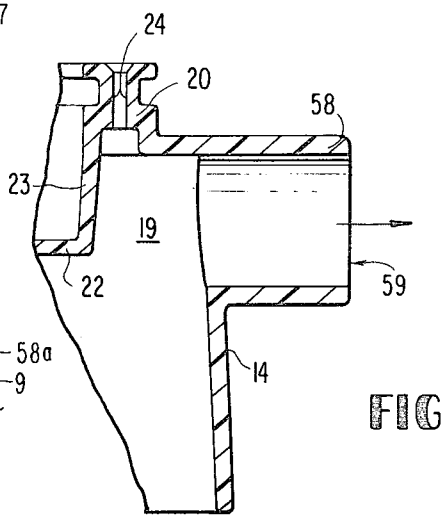
FIG. 6 is a partial cross sectional view taken along the section line 6—6 of FIG. 1.

Referring now to FIG. 1 (from which the top housing cover 55 disclosed in FIG. 2 has been omitted for clarity) and FIG. 5, the tubular wall 56 of an exhale pipe 57, that connects to the exhale tube **57*a* of the wearer's face mask 9, passes through the variable volume gas chamber space 19 into the lower chamber portion 30 of the gas conditioning chamber 18. Referring now to FIGS. 1 and 6, the tubular wall 58 of an inhale pipe 59, that connects to the inhale tube 57*a* of the wearer's mask 9, terminates inside the outer peripheral wall 14 of the frame in the variable volume gas chamber 19**.

Figure 4:
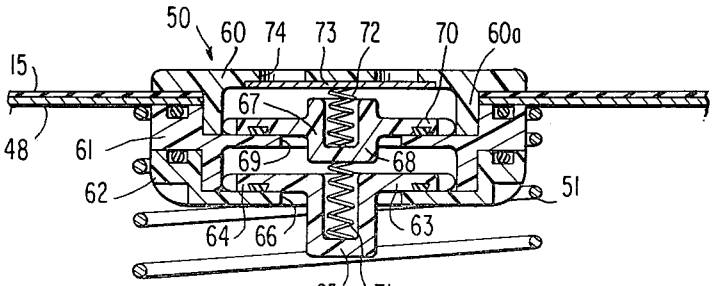
FIG. 4 is a cross sectional view of a vent valve installed in the unit.

As previously noted, the dual vent valve 50 affixed to the central portion of the flexible diaphragm 15 interconnects the variable volume gas chamber 19 and the space included between the flexible diaphragm 15 and the bottom cover plate 45 which communicates with the outside environment through the cover plate opening 46. As best seen in FIG. 4, the vent valve includes a base plate 60 pierced by apertures 74 with a cylindrical rim portion **60*a* extending through an opening in the diaphragm 15 and its support plate 48, an upper valve body 61 lying below the diaphragm 15 and diaphragm plate 48, and a lower valve body 62 in nesting contact with and below the upper valve body 61. A lower valve poppet 63 having a peripheral rim 64 resting on the seat of the lower valve body 62 has a central projection 65 extending downwardly through a central opening 66 in the lower valve body 62. An upper valve poppet 67 with a central portion 68 protruding through a central opening 69 in the upper valve body 61 has a peripheral rim 70 resting on the seat of the upper valve body 61. A compression spring 71 positioned between the upper and lower valve poppets 63, 67 and compression spring 72 positioned between the upper valve poppet 67 and a stainless steel element 73 resting on the lower face of the base plate 60 over apertures 74, normally maintains the upper and lower valve poppets in a seated position on the valve seats as illustrated in FIG. 4**.

Figure 3:
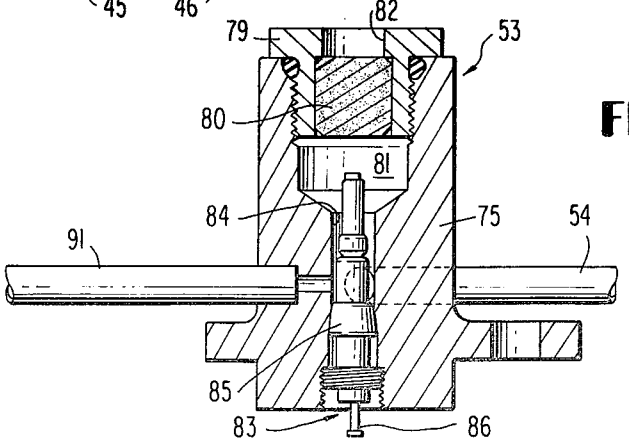
FIG. 3 is a cross sectional view of an oxygen metering device mounted within the unit.
Figure 8:
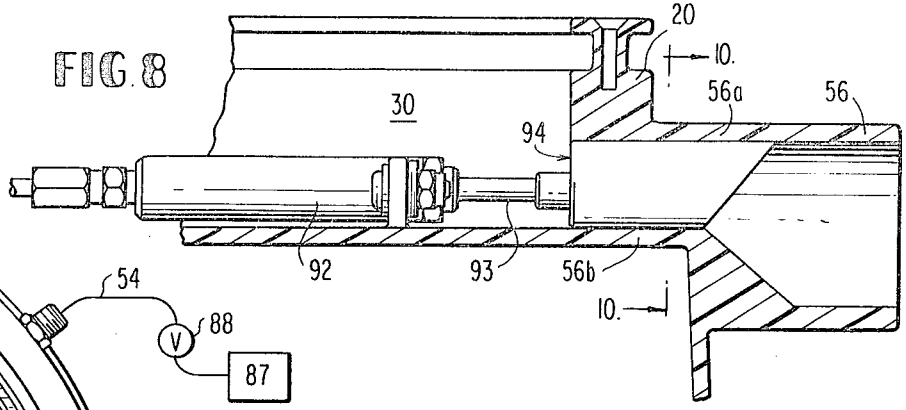
FIG. 8 is a cross sectional view of the apparatus along the section line 8—8 with an anti-anoxia valve in the closed position.

The structure of the oxygen metering device 53 is illustrated in FIG. 3. A hollow housing 75 of this device extends through an opening 76 in the bottom portion of the upper frame dish shaped portion 22 and is sealingly secured in this position by bolts 77 and gaskets 78 with the bottom of the housing in communication with the variable volume gas chamber 19 and the top portion extending upwardly within the lower gas conditioning chamber 30. The lower portion of the hollow interior of a tubular threaded cap 79, threadably engaged within the enlarged upper hollow portion 81 of the housing, contains a gas flow restrictor 80 below the lesser diameter passage 82 that opens into the lower chamber 30. A passage 84 extending from the housing upper enlarged hollow interior 81 through the bottom of the housing into communication with the variable volume gas chamber 19 connects to the oxygen supply pipe 54. The restrictor 80 limits the flow of oxygen from the metering device into the lower gas conditioning chamber 30 to approximately one and one-half liters per minute. A spring loaded valve 83 having a seal 85, similar to the air valve in an automobile tire, is threadably contained within the lower end of the passage 84. In the normally closed position illustrated in FIG. 3 the valve is closed. When the valve stem 86 is pushed upwardly the valve opens to permit oxygen in the passage 84 to flow downwardly and out of the bottom of the housing 75 into the variable volume gas chamber 19.

Figure 9:
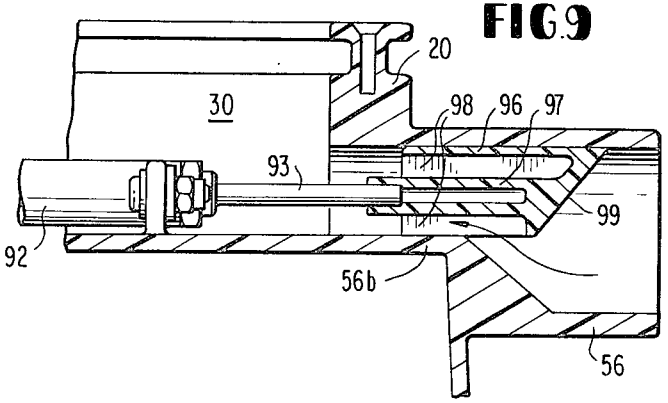
FIG. 9 is a cross sectional view corresponding to the view of FIG. 8 with the anti-anoxia valve in the open position.
Figure 10:
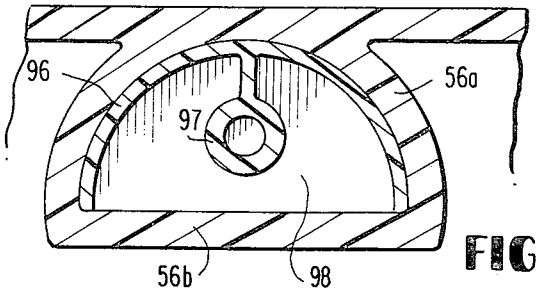
FIG. 10 is a cross sectional view of the anti-anoxia valve along the section line 10—10 of FIG. 8.
Figure 7:
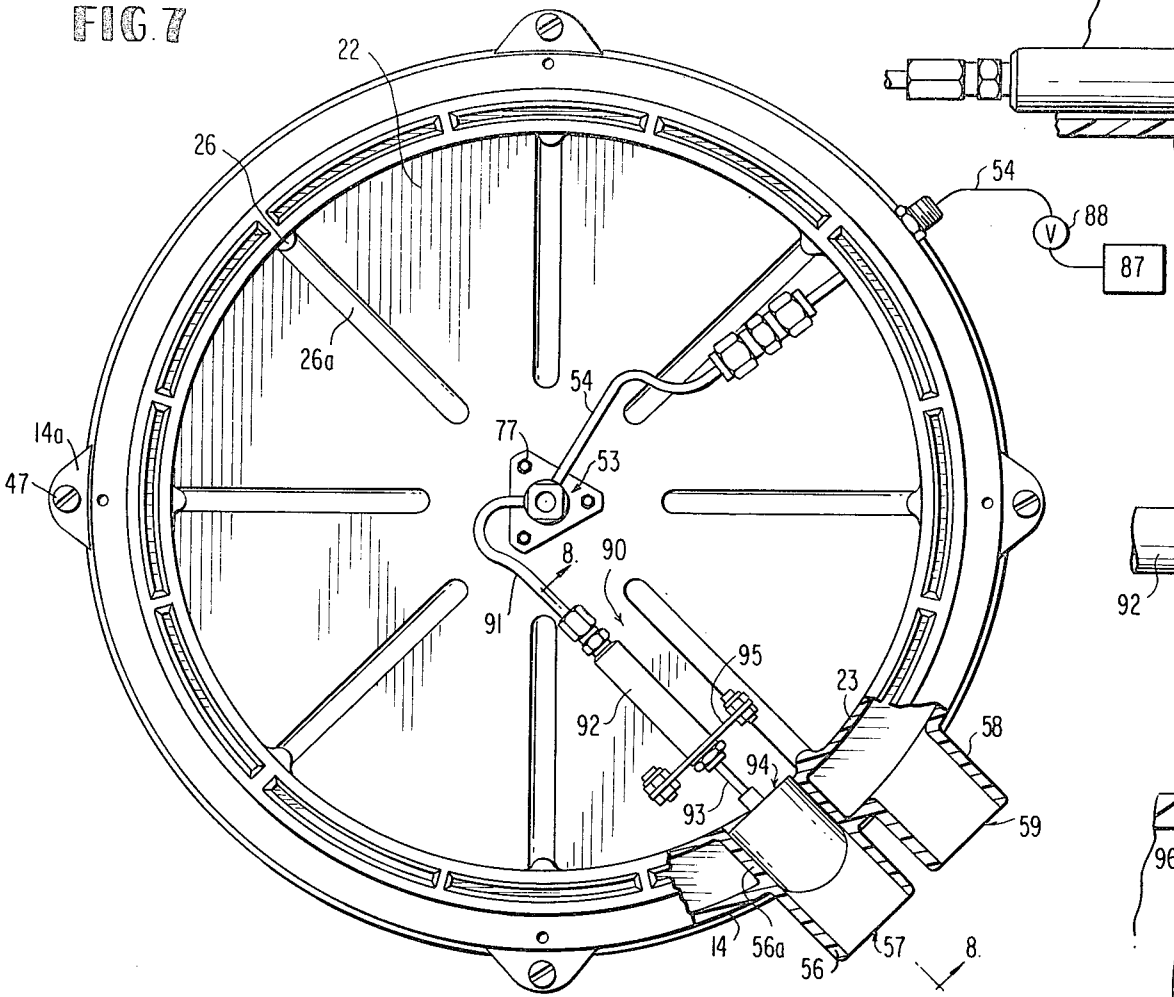
FIG. 7 is a plan view of a lower portion of the apparatus shown in FIG. 1 with upper portions removed.

The anti-anoxia device 90 can best be seen in FIGS. 7, 8, 9 and 10. The device comprises an elongated cylinder 92 affixed to the pan 22 of the upper frame section by the bracket assembly 95. One end of the cylinder is connect to the pressure line 91 connected to the metering device 53 and a piston rod 93 of a spring retractable actuating piston in the cylinder 92 extends from the other end with the end of the rod affixedly contained within an axially extending inner sleeve 97 of a hollow, anti-anoxia valve 94 which has an axially extending, semi-circular upper wall conforming to the same semi-circular cross sectional shape of and in axial alignment with the interior segment 56*a* of the exhale tubular wall 56. The cross sectional shape of the valve structure can best be appreciated in FIGS. 9 and 10. The anti-anoxia valve 94 has a hollow interior 98 that extends from an open rear end to an oblique, solid forward wall 99 of the valve with the hollow interior overlying the flat bottom portion 56*b* of the interior segment of the exhale tube tubular wall 56. The length of the anti-anoxia valve and the travel of the piston and rod of the cylinder are such that, when the piston in the cylinder 92 is in the retracted position with no gas pressure within the cylinder, the anti-anoxia valve is in the retracted position illustrated in FIG. 8 with the forward face 99 of the valve blocking the semi-circular inner passage 56*a* of the exhale pipe 57 and, when the piston is moved to the extended position by the application of oxygen pressure to the cylinder, the valve 94 is moved into the outer circular wall area 56 of the exhale tube to bring the hollow interior 98 of the valve into communication with the exhale tube as illustrated in FIG. 9, whereby the wearer's exhale gases can enter the lower gas conditioning chamber 30 and normal breathing can occur.

Upon donning the rebreathing apparatus, the wearer opens the oxygen supply valve 88 to provide a flow of oxygen through the supply tube 54 into the metering device 53 which will establish a constant flow of oxygen through the restrictor 80 of approximately one and one-half liters per minute into the lower chamber 30 of the gas conditioning chamber 18. This added oxygen is normally sufficient to replace the oxygen that is consumed by the wearer, exhaled in the form of $CO_2$ and removed by the chemicals in the canister. The exhaled breath of the wearer flows from the exhale tube of the wearer's mask into the lower chamber 30 of the gas conditioning chamber through the exhale pipe 57 when the oxygen supply valve has been opened and the anti-anoxia valve positioned in the extended, open position as previously explained. In the event the oxygen supply valve has not been opened at the time of donning the mask, the forward wall 99 of the retracted anti-anoxia valve will prevent continued breathing into the mask, which if not prevented would cause the wearer generally to suffer a loss of oxygen resulting in an insidious onset of anoxia. The gases exhaled by the wearer into the lower gas conditioning chamber 30 and enriched by oxygen will flow in an even pattern upwardly through the bottom openings 34 of the canister 31, through the $CO_2$ removal chemicals 40 and into the upper gas conditioning chamber 29 through the perforations 43 in the cover of the canister, the $CO_2$ being absorbed by the chemicals 40. This reconditioned breath of the wearer then flows downwardly around the periphery of the frame of the apparatus through the peripherally extending apertures 24 in the annular shoulder of the frame into the variable volume gas chamber 19 forcing the diaphragm downwardly and compressing spring 51 which is already in a partially compressed state. The reconditioned gases in the variable volume gas chamber 19 are then inhaled by the wearer through the inhale pipe 59 that connects to the inhale tube of the wearer's mask causing the diaphragm to move upwardly. The direction of flow is controlled by means of the usual check valve arrangement (not illustrated). In the event the wearer is consuming extra amounts of oxygen over the one and one-half liters normally continuously flowing into the gas conditioning chamber 30 through the restrictor 80, the volume of reconditioned gases in the variable gas volume 19 will decrease so as to cause the flexible diaphragm 15 to flex upwardly to the extent that the vent valve 50 strikes the valve stem 86 of the oxygen metering device and permit additional oxygen to flow into the variable volume gas chamber 19. The upward force exerted on the diaphragm plate 48 by the compressed spring 51 causes the gas pressure within the system to be elevated above ambient pressure ensuring that any small amount of gas leakage will be outwardly, thereby preventing the incursion of undesirable and toxic elements from the ambient atmosphere in which the wearer is operating. In the event the volume of gases in the variable volume gas chamber 19 should increase for some reason, such as the wearer consuming a lesser amount of oxygen than flows through the restrictor 80 of the oxygen metering device, the diaphragm 15 will flex downwardly until the lower projection 65 of the lower seat of the vent valve contacts the central raised portion 52 of the bottom cover plate 45. The upward movement of the valve poppets 63 and 67 against the pressures of the spring 71 and 72 will connect the interior of the vent valve 50 to the space below the diaphragm 15 permitting excess gas to flow out of the system. By incorporating the dual, series arrangement of the valve poppets 63 and 67 in the vent valve, the vent valve is prevented from remaining open should a particle or some other type of contamination become wedged between one of the valve seats and the valve poppet. Normally a manual shut-off would be required in the usual type of single valve vent valves in the event contamination causes the valve to stick open. However, such a remote controlled valve is difficult to incorporate into the interior of a closed gas regenerator unit. The dual valve arrangement described above provides a sufficient safety factor that a manual shut-off valve is not necessary.

The described configuration of the carbon dioxide scrubber retains the carbon dioxide removal chemicals in a uniformly and tightly compacted state during the useful life of the chemicals, which is essential in establishing and maintaining a uniform flow of the exhale gases across the entire cross sectional area of the scrubber as the gases pass from the lower gas conditioning chamber 30 to the upper chamber 29. Unless the carbon dioxide removal chemicals are maintained in a uniformly, tightly packed condition at all times, the exhale gases will establish discrete channels through the chemical particles resulting in a non-uniform flow of the gases through the scrubber chemicals. The compression of the resilient pad 41, located between the canister cover 42 and the chemicals 40 filling the canister, maintains the chemicals 40 in a uniformly and tightly compacted state, thus assuring an evenly and tightly packed distribution of the chemicals within the canister at all times even after the rebreathing apparatus has been in use for some time and subjected to a moderate amount of rough handling. The arrangement whereby the canister cover 42 is held in place over the resilient pad 41 and fastened to the central segment 36 of the canister by means of the slide fastener 44 permits quick and easy replacement of expended carbon dioxide removal chemicals. After emptying the canister 31, fresh chemicals are poured into the canister which is lightly tapped to settle the chemicals within its interior to bring the level of chemicals somewhat above the inner central segment 36 of the canister. The compression of the resilient pad 41 that is pressed against the chemicals after the canister cover is fastened onto the canister will further settle the chemical particles and maintain them in a uniformly tightly packed condition.

It should be understood that the foregoing disclosure relates only to a preferred embodiment of the invention and that numerous modifications or alterations may be made therein without departing from the spirit and scope of the invention as set forth in the appended claims.

We claim:

1. In a closed circuit rebreathing apparatus having breathing exhale and inhale circuit means and gas conditioning means connected between said exhale and inhale circuit means, the improvement wherein said gas conditioning means comprises a hollow frame member having an open bottom end defined by the lower edge of an annular outer peripheral wall extending upwardly to an upper pan section extending transversely across the span of said outer annular peripheral wall, a flexible diaphragm extending transversely of and sealingly secured around its periphery to said frame outer peripheral wall adjacent said frame open end, the space enclosed within said outer peripheral wall, said upper pan section and said flexible diaphragm defining a variable volume gas chamber, said upper pan section comprising a dish shaped portion having an imperforate central portion extending transversely of and concentrically within an annular wall section extending upwardly from the outer periphery of said central portion to an annular shoulder joining said frame outer annular peripheral wall and the annular wall of said pan dish shaped portion, said frame annular shoulder having a plurality of passages spaced along its circumference connecting the span above said upper pan to said variable gas volume chamber, a carbon dioxide removal canister supported in said pan dish shaped portion, said carbon dioxide removal canister having perforated upper and lower surfaces and configured to sealingly fit within said dish shaped portion with the lower surface of an installed canister in a spaced relation to said pan central portion in defining a lower gas conditioning chamber between said pan dish shaped portion and said canister lower surface, a top cover releasably affixed to said frame and extending across the span of said frame outer peripheral wall in spaced relation to the top surface of said carbon dioxide removal canister, the spaces enclosed between said top cover and said canister top surface defining an upper gas conditioning chamber connecting to said variable volume gas chamber by said frame shoulder passages, means supplying predetermined amounts of make-up oxygen to the gases passing through said gas conditioning means, means connecting to said exhale circuit means for forming an exhale passage extending through said frame outer peripheral wall, said variable volume gas chamber and said pan dish shaped portion annular wall into said lower gas conditioning chamber, and means connecting to said inhale circuit means for forming an inhale passage extending through said frame outer peripheral wall into said variable volume gas chamber.

2. The apparatus of claim 1 wherein said make-up oxygen supplying means includes a pressurized source of oxygen, means metering a constant perdetermined flow of oxygen gas into one of gas conditioning chambers and means connecting said oxygen metering means and said oxygen source.

3. The apparatus of claim 2 additionally comprising means associated with said oxygen metering means and actuatable by contact with said flexible diaphragm upon movement of the diaphragm a predetermined distance into said variable volume gas chamber for releasing additional oxygen from said source into a space within said gas conditioning means.

4. The apparatus of claim 3 wherein said oxygen metering means is affixed to the central portion of said pan dish shaped central portion and said diaphragm actuatable additional oxygen releasing means comprises a valve in the lower portion of said oxygen metering means, said valve having a valve actuator extending through said pan dish shaped central portion into said variable volume gas chamber.

5. The apparatus of claim 1 additionally comprising an anti-anoxia valve movable betwen a closed position within said exhale passage blocking gases from flowing from said exhale circuit means through said exhale passage and an open position opening said exhale passage to the flow of gases from said exhale circuit means, and means operably connected to said oxygen releasing means moving said valve to said closed position when oxygen pressure to said metering means is below a predetermined amount and moving said valve to the open position when said oxygen pressure attains said predetermined amount.

6. The apparatus of claim 5 wherein a portion of said exhale passage adjacent said gas conditioning chamber has a constant cross sectional contour of lesser cross sectional dimension than the remainder of said exhale passage, said anti-anoxia valve is a hollow body having a transversely extending end wall closing the end of the body hollow interior and having the opposite end open to the hollow interior, and said body exterior is contoured to slidably fit within said exhale passage lesser dimension portion for movement between said closed position in which said valve closed end wall lies within and blocks said exhale passage lesser dimension portion and said open position in which said valve end wall lies within said exhale passage remainder portion and the hollow interior and open end of said valve body connect said exhale passage remainder portion and said gas conditioning chamber.

7. The apparatus of claim 1 additionally comprising means biasing said diaphragm inwardly of said variable volume gas chamber establishing a positive pressure above ambient of the gases flowing through said rebreathing apparatus.

8. The apparatus of claim 7 additionally comprising a vent valve supported by said flexible diaphragm operable for venting gas from said variable volume gas chamber upon actuation to an open position, vent valve actuating means operable to actuate said vent valve to the open position upon said flexible diaphragm moving outwardly a predetermined amount upon expansion of the gas volume within said variable volume gas chamber.

9. The apparatus of claim 8 wherein said vent valve includes a hollow valve body sealingly affixed onto and protruding through said flexible diaphragm, said valve body having two internal valve seats interposed in series between openings to said variable volume gas chamber and ambient space exteriorly of said diaphragm and frame, and two spring biased valve poppets connected in series within said valve body each movable between a closed position seated on one of said valve seats and an opened position lifted off the valve seat, the lowermost valve poppet most remote from said variable volume gas chamber having a projection contactable with an apertured lower cover affixed to the lower end of said frame to cause said valve poppets to be lifted to the open position upon sufficient downward movement of said diaphragm and valve.

10. In a closed circuit, positive pressure rebreathing apparatus for reconditioning a wearer's breathing gases passing through exhale and inhale breathing circuit means from the wearer's respiratory system through a breathing gas conditioning means, said breathing gas conditioning means comprising a hollow frame member having an open bottom end defined by the lower edge of an annular outer peripheral wall extending upwardly to an upper divider extending transversely across the span of said outer annular peripheral wall; a flexible diaphragm extending transversely of and sealingly secured around its periphery to said frame outer peripheral wall adjacent said frame lower open end, the space within said frame outer peripheral wall and upper divider and said flexible diaphragm defining a variable volume gas chamber; a top cover affixable to and extending across the span of said frame outer peripheral wall in spaced relation to said frame upper divider, the space contained between said frame upper divider and said top cover defining a gas conditioning chamber; a carbon dioxide removal canister supported in said frame to extend transversely of said gas conditioning chamber spaced from said cover and said divider dividing said gas conditioning chamber into a lower and an upper gas conditioning chamber; passage means connecting gas conditioning chamber and said variable volume gas chamber; said carbon dioxide removal canister, adapted to contain carbon dioxide removal chemicals, having perforated upper and lower surfaces and means to sealingly fit within said frame permitting the passage of gases between said upper and lower gas conditioning chambers; a vent valve supported on and extending through said diaphragm and having means for being actuated between a closed position and an open position connecting said variable volume gas chamber to ambient atmosphere outside said gas conditioning means by the movement of said diaphragm as the volume of said variable volume gas chamber fluctuates by predetermined amounts; an oxygen supply and enriching device comprising a hollow housing affixed to said frame member upper divider with the lower end of the housing extending through said upper divider, the hollow interior of said housing having a connection to a pressurized source of oxygen and an upper and a lower passage connecting respectively with said lower gas conditioning chamber and said variable volume gas chamber, said upper passage containing metering means for restricting the flow of oxygen through said upper passage to a constant, predetermined amount and said lower passage containing a normally closed oxygen enriching valve operable between the closed position and an open position by an actuator extending downwardly into said variable volume gas chamber, said adapter being adapted to be contacted by said diaphragm upon its upward movement when the volume within said variable volume gas chamber decreases to a predetermined amount for opening said enriching valve and causing additional oxygen to be released into said variable volume gas chamber; and biasing means connected to said frame and said flexible diaphragm biasing said flexible diaphragm inwardly of said variable volume gas chamber establishing a positive pressure above ambient upon the breathing gases within said rebreathing apparatus.

11. The apparatus of claim 10 additionally comprising an anti-anoxia valve movable between a closed position blocking breathing gases from flowing through said breathing circuit and breathing gas conditioning means and an open position establishing freedom of breathing gases to flow through said breathing circuit and breathing gas conditioning means, and means operable connected to said oxygen metering means moving said anti-anoxia valve to said closed position when the pressure of oxygen from said source to said oxygen metering means is below a predetermined load and moving said valve to the open position when said oxygen pressure attains said predetermined level.

12. A carbon dioxide scrubber for a closed circuit rebreathing apparatus comprising a hollow concave container adapted to hold carbon dioxide removal chemicals therein and having an open top end defined by an outer peripheral wall section extending downwardly to a transversely extending bottom section comprising an annular perforated section coaxial of an unperforated, elevated center section defined by an annular, inner upstanding wall across the top periphery of which extends a transversely extending central segment and annular filter supporting ledges adjacent to and raised a small distance above said perforated section to extend circumferentially of said outer peripheral wall section and said inner upstanding wall; an annular porous filter element supported along its outer and inner edges on said filter supporting ledges to overlie said bottom section in a spaced relationship to the perforated area of said bottom section; a pad of porous, compressible material extending across and fitting within the upper portion of said container open top end with the central lower surface of said pad resting on said central segment of said bottom section elevated center section, said pad, said container peripheral wall, said elevated center section and said porous filter element defining a closed space for holding carbon dioxide removal chemicals; a perforated cover plate engageable with the upper edge of said peripheral wall section and the upper surface of said pad; and clamping means releasably engageable with said bottom section elevated center portion and the central area of said cover to bring the outer peripheral edge of said cover into contact with the upper edge of said container outer peripheral wall and its lower surface into contact with the underlying pad compressing said pad into pressing contact with carbon dioxide removal chemicals which would fill said closed space and would be retained in a tightly compacted state by the pressure of said pad.

13. The scrubber of claim 12 wherein said pad is formed from foamed polyurethyne.

14. The scrubber of claim 13 wherein said filter element comprises sintered polyethylene.

15. In a closed circuit rebreathing apparatus having a carbon dioxide scrubber comprising an open top, concave container having particles of a carbon dioxide removal chemical disposed therein and having an outer annular wall extending upwardly from a transversely extending bottom having spaced-apart perforations and a filter supporting surface extending circumferentially of said bottom section and raised a short distance above the area containing said perforations, a flat, porous filter element supported along its peripheral edges on said supporting surface in an overlying and spaced relation to said bottom perforated area, a perforated cover adapted to be detachably affixed to said container and configured to extend across the top open span of said container in contact with the periphery of said container outer wall, and means for attaching said cover to said container after being filled with loose particles of a $CO_2$ absorbing chemical resting on said filter element; the improvement of a pad of porous, compressible material extending spanwise of the upper, open end of said container and of a thickness and shape to be engaged by said cover attached to said container by said attaching means in compressive engagement between said cover and said $CO_2$ absorbing particles with which said container is filled, said container bottom comprising an annular portion containing said perforations coaxial of an unperforated, elevated center section extending upwardly from said container bottom through said porous filter element into contact with said pad, and said attaching means includes means for releasably engaging a central portion of said cover to said elevated center section.

16. In a closed circuit rebreathing apparatus having exhale and inhale passages connecting with a gas conditioning compartment that includes a $CO_2$ scrubber and an oxygen replenishing device connected to a pressurized source of oxygen, an anti-anoxia device comprising an anti-anoxia valve movable between a closed position in one of said passages blocking the flow of breathing gases through said one passage and an open position opening said passages to the flow of breathing gas, and means operably connected to said oxygen replenishing device moving said anti-anoxia valve to said closed position when the oxygen pressure received by said oxygen replenishing device is below a predetermined amount and moving said valve to the open position when said oxygen pressure attains said predetermined amount, at least a portion of the length of said one passage having a constant cross sectional contour of lesser cross sectional dimension than adjoining segments, said valve is a hollow body having a transversely extending end wall closing one end of the hollow interior and having the opposite end open to the hollow interior, and said body exterior is contoured to slidably fit within said one passage lesser dimension portion for movement between said closed position in which said valve end wall lies within and blocks said one passage lesser dimension portion and said open position in which said valve closed end wall lies within one of said passage adjoining segments and the hollow interior and open end of said body are in communication with said one adjoining passage segments.

17. The apparatus of claim 16 wherein said one adjoining segment is an extension of said one passage constant cross sectional portion lying opposite to said gas conditioning compartment.

18. The apparatus of claim 17 wherein said moving means comprises means operatively connected to said oxygen replenishing source and said valve body for moving said body axially of said one passage between said positions.

19. The apparatus of claim 18 wherein said moving means is affixed within said gas conditioning chamber in axial alignment with the exhale passage.

* * * * *